US006843229B2

(12) United States Patent
Bauerle et al.

(10) Patent No.: US 6,843,229 B2
(45) Date of Patent: Jan. 18, 2005

(54) DISPLACEMENT ON DEMAND FAULT INDICATION

(75) Inventors: Paul A. Bauerle, Fenton, MI (US); Kerfegar K. Katrak, Fenton, MI (US); Kevin J. Storch, Brighton, MI (US); Alfred E. Spitza, Jr., Brighton, MI (US); Kevin C. Wong, Ann Arbor, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/464,269

(22) Filed: Jun. 18, 2003

(65) Prior Publication Data

US 2004/0255905 A1 Dec. 23, 2004

(51) Int. Cl.[7] ..... F02D 41/00

(52) U.S. Cl. ..... 123/396; 123/681; 123/436; 123/481; 123/198 F

(58) Field of Search ..... 123/396, 436, 123/481, 681, 198 F

(56) References Cited

U.S. PATENT DOCUMENTS 6,381,953 B1 * 5/2002 Glugla et al. ..... 60/284
6,499,449 B2 * 12/2002 Michelini et al. ..... 123/90.15
6,615,804 B2 * 9/2003 Matthews et al. ..... 123/481
6,647,947 B2 * 11/2003 Boyer et al. ..... 123/198 F
6,684,151 B1 * 1/2004 Ring ..... 701/110
2003/0213466 A1 * 11/2003 Rayl ..... 123/399

* cited by examiner

*Primary Examiner*—Willis R. Wolfe
*Assistant Examiner*—Johnny H. Hoang
(74) *Attorney, Agent, or Firm*—Christopher DeVries

(57) ABSTRACT

An engine control system for monitoring torque increase during cylinder deactivation for a displacement on demand (DOD) engine includes a throttle and a controller. The controller adjusts a preload of the throttle prior to a cylinder deactivation event and determines whether a DOD fault is present during the cylinder deactivation event. The controller one of operates the engine without the preload in the deactivated mode and switches the engine back to the activated mode if the fault is present for a predetermined time. The controller cancels the preload if the DOD fault is present and resets the preload if the predetermined period has not expired. The DOD fault includes one of an engine speed fault, a transmission gear fault and a fueled cylinder fault.

27 Claims, 3 Drawing Sheets

DISPLACEMENT ON DEMAND FAULT INDICATION

FIELD OF THE INVENTION

The present invention relates to engine control systems, and more particularly to fault indication in displacement on demand engine control systems.

BACKGROUND OF THE INVENTION

Some internal combustion engines include engine control systems that deactivate cylinders under low load situations. For example, an eight cylinder can be operated using four cylinders. Cylinder deactivation improves fuel economy by reducing pumping losses. To smoothly transition between activated and deactivated modes, the internal combustion engine should produce torque with a minimum of disturbances. Otherwise, the transition will not be transparent to the driver. Excess torque causes engine surge and insufficient torque causes engine sag, both of which degrade the driving experience.

For an eight-cylinder engine, intake manifold pressure is significantly lower during eight-cylinder operation than during four-cylinder operation. During the transition from eight to four cylinders, there is a noticeable torque reduction or sagging in four-cylinder operation until the intake manifold reaches a proper manifold pressure level. In other words, there is less engine torque when cylinders are deactivated than when the cylinders are activated for the same accelerator position. The driver of the vehicle would be required to manually modulate the accelerator to provide compensation for the torque reduction and to smooth torque.

In commonly-owned U.S. patent application entitled "Engine Control System With Throttle Preload During Cylinder Deactivation", Ser. No. 10/150,522, filed May 17, 2002, which is hereby incorporated by reference in its entirety, the throttle limit is adjusted to an increased position prior to cylinder deactivation to provide compensation. In "Spark Retard Control During Cylinder Transitions in a Displacement on Demand Engine", Ser. No. 10/150,879 filed May 17, 2002, which is hereby incorporated by reference in its entirety, the increased throttle position or preload is accompanied by spark retard to offset torque increase caused by the preload before the cylinders are deactivated.

SUMMARY OF THE INVENTION

The present invention provides an engine control system for monitoring torque increase during cylinder deactivation for a displacement, on demand (DOD) engine including activated and deactivated modes. The engine control system includes a throttle and a controller. The controller adjusts a preload of the throttle prior to a transition to the deactivated mode and determines whether a DOD fault is present during the cylinder deactivation event. The controller one of operates the engine without the preload in the deactivated mode and switches to the activated mode if the fault is present for a predetermined time.

In one feature, the controller cancels the preload if the DOD fault is present and resets the preload if the predetermined period has not expired.

In another feature, the controller retards spark based on the preload prior to the transition to the deactivated mode.

In another feature, an indicator receives a DOD fault signal from the controller after the predetermined time period expires to indicate the presence of the DOD fault.

In still another feature, the preload is based on a desired throttle position for the deactivated mode.

In yet another feature, the DOD fault is an engine speed fault. An engine speed sensor generates an engine speed signal that is processed by the controller to determine whether the engine speed fault is present.

In yet another feature, the DOD fault is a transmission gear fault. A transmission sensor generates a signal based on a current transmission gear that is processed by the controller to determine whether the transmission gear fault is present.

In yet another feature, the DOD fault is a fueled cylinder fault. A fuel supply sensor generates a fuel supply signal that is processed by the controller to determine whether the fueled cylinder fault is present.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
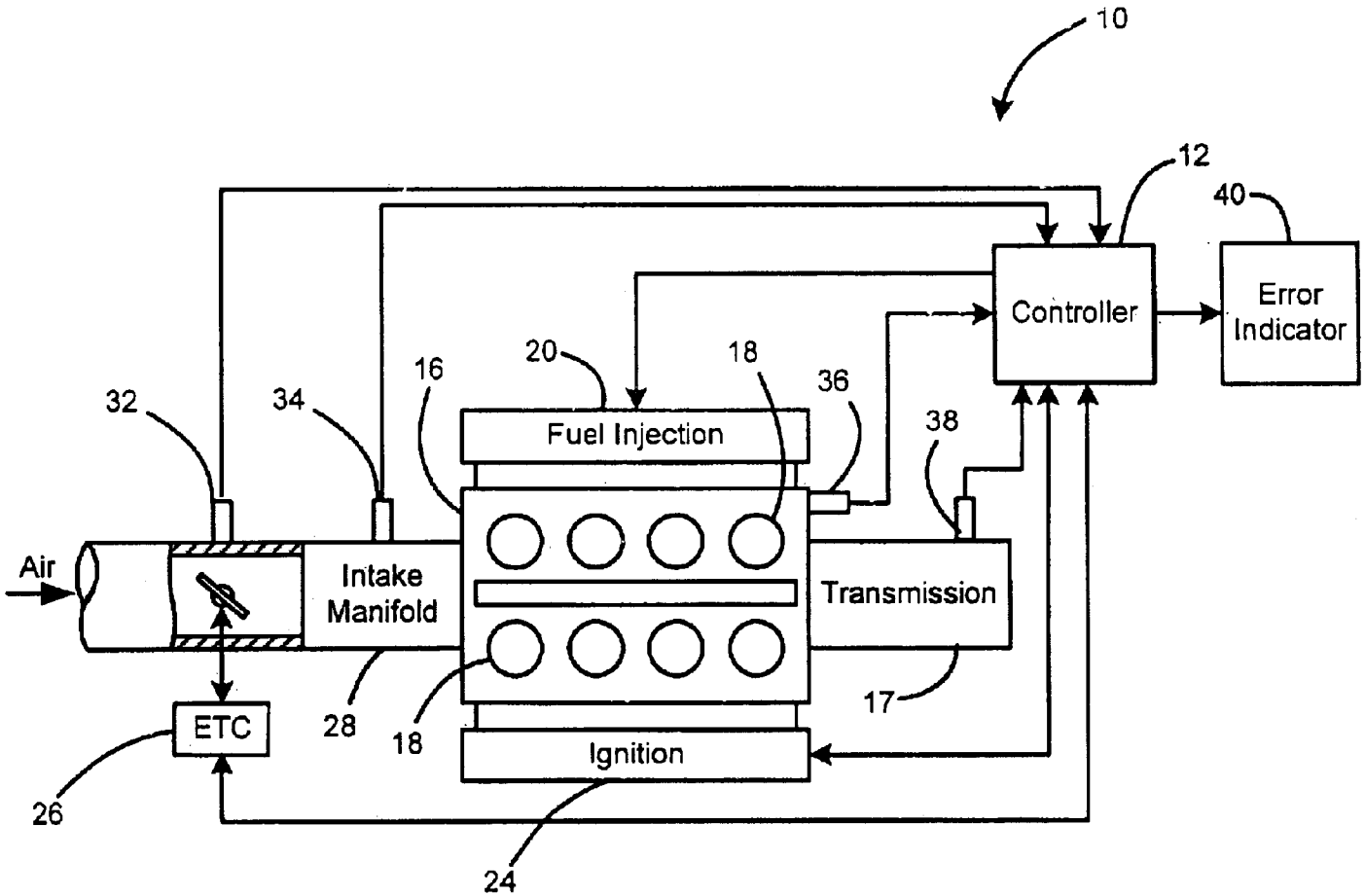
FIG. 1 is a functional block diagram of an engine control system that monitors displacement on demand according to the present invention.

The following description of the preferred embodiment(s) is merely exemplary in nature and is in no way intended to limit the invention, its application, or uses. For purposes of clarity, the same reference numbers will be used in the drawings to identify similar elements.

As used herein, activated refers to engine operation using all of the engine cylinders. Deactivated refers to engine operation using less than all of the cylinders of the engine (one or more cylinders not active). Furthermore, the exemplary implementation describes an eight cylinder engine with cylinder deactivation to four cylinders. However, skilled artisans will appreciate that the disclosure herein applies to cylinder deactivation in engines having additional or fewer cylinders such as 4, 6, 10, 12 and 16.

Referring now to FIG. 1, an engine control system 10 according to the present invention includes a controller 12, an engine 16 and a transmission 17 driven by the engine 16. The engine 16 includes a plurality of cylinders 18 each with one or more intake valves and/or exhaust valves (not shown). The engine 16 further includes a fuel injection system 20 and an ignition system 24. An electronic throttle controller (ETC) 26 adjusts a throttle area into an intake manifold 28. It will be appreciated that ETC 26 and controller 12 may include one or more controllers.

A throttle position sensor generates a throttle position signal that is sent to the controller 12. A temperature sensor 34 generates an intake manifold temperature signal that is sent to the controller 12. An engine speed sensor 36 generates an engine speed signal that is sent to the controller 12. A transmission sensor 38 generates a gear signal that is sent to the controller 12. The gear signal indicates the current gear in which the transmission 17 is operating. The controller 12 receives a signal from the fuel injection system 20 indicating the number of cylinders 18 currently fueled.

The controller 12 monitors the various sensors described herein to determine whether cylinder deactivation is appropriate. This deactivation decision is based on engine load. If the engine load is sufficiently light, a select number of cylinders 18 are deactivated and the power output of the remaining or activated cylinders 18 is increased. The controller 12 determines a throttle preload prior to transitioning to the deactivated mode. The throttle preload is based on a desired throttle position during cylinder deactivation. That is to say, the throttle preload is based on the throttle position required to increase the power output of the activated cylinders.

Prior to transitioning into the deactivated mode, the controller 12 retards engine spark based on the throttle preload. The throttle preload is accompanied by the spark retard to offset torque increase caused by the preload before the cylinders are deactivated. Once transition to the deactivated mode is complete the spark retard is reduced. Smoothing of the transition to the deactivated mode is performed using spark retard with the throttle preload.

Prior to completing the transition to the deactivated mode, the controller 12 monitors the various sensors for the presence of a DOD fault. The DOD fault includes but is not limited to the following: torque increase, gear state and fueled cylinders. Torque increase can be determined in a number of manners including engine speed change. A detailed discussion of the manners in which torque increase can be determined is found in U.S. Ser. No. 10/368,895 filed Feb. 18, 2003 and entitled "Displacement On Demand with Throttle Preload Security Methodology", the disclosure of which is expressly incorporated herein by reference in its entirety. With regard to engine speed change, the controller 12 monitors the engine speed sensor signal to determine whether the engine speed change is within a threshold. If the engine speed change is within the threshold, torque increase is not detected. If the engine speed change is above the threshold torque increase is detected and the controller signals a fault.

The gear state is determined by the transmission sensor 38. The controller 12 identifies the current transmission gear. If the gear is not one in which deactivation is allowed, the controller 12 signals a fault. Similarly, the controller 12 process the fuel injection system signal to determine the number of cylinders 18 that are fueled. If the number of cylinders 18 fueled is not equal to the number of cylinders 18 that are to be fueled in the deactivation mode, the controller 12 signals a fault.

If a fault has been signaled during transition to the deactivated mode, the controller 12 cancels the throttle preload and determines whether a predetermined number of transition attempts to the deactivated mode have occurred. If the result is false, the controller 12 cancels the present transition and determines the throttle preload. If the result is true, the controller 12 signals an engine error and finishes transition to the deactivated mode and operates the engine 16 without the throttle preload. The engine error can be indicated using audio and/or on a visual indicator 40 such as a check engine lamp. Additionally, the engine error sets a flag in the controller 12 that corresponds to the particular DOD fault. The flag can be read by maintenance personnel during inspection of the vehicle. As a result, the maintenance personnel can correct the fault.

Figure 2:
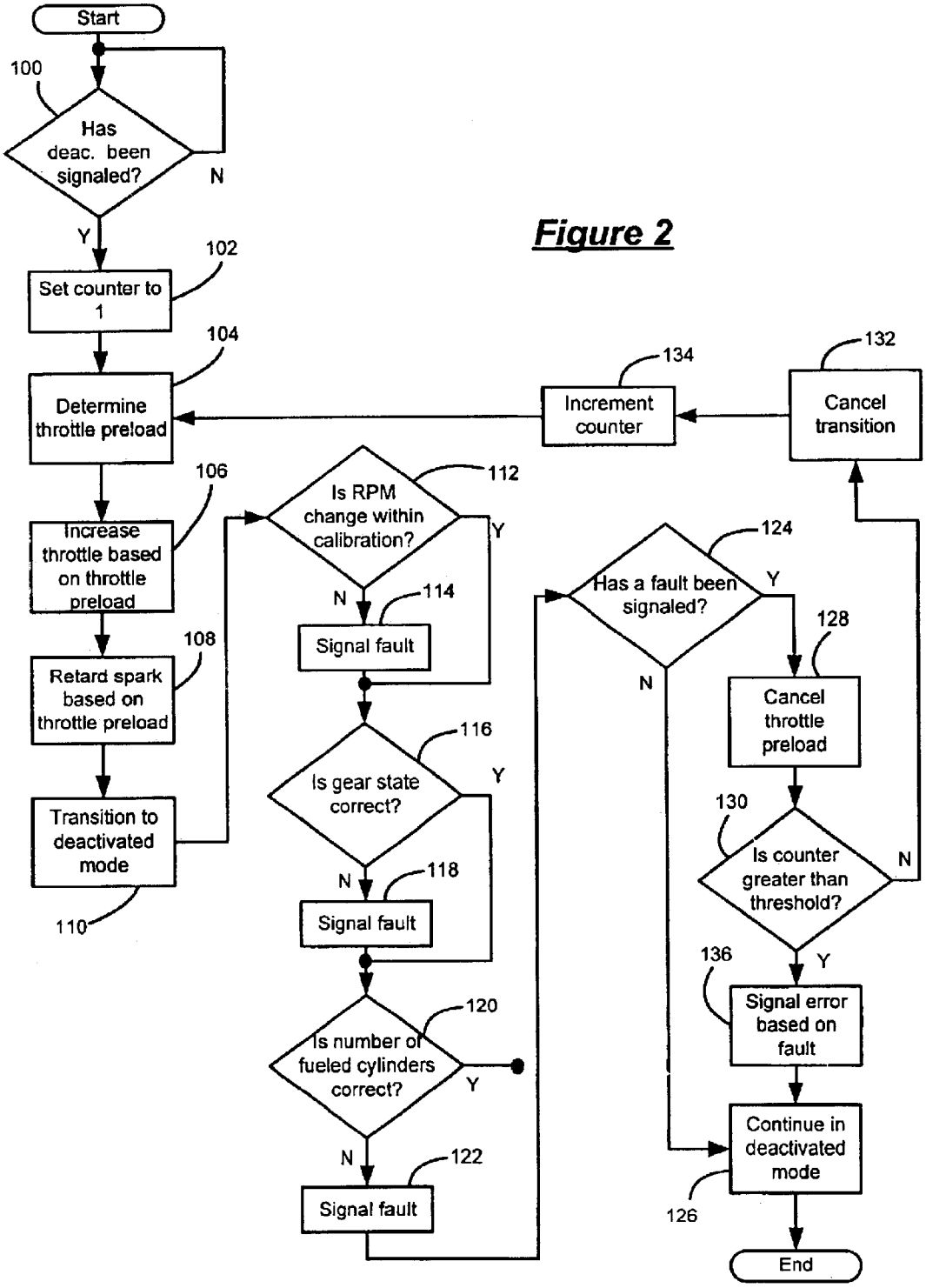
FIG. 2 is a flowchart illustrating steps performed by a displacement on demand controller.

Referring now to FIG. 2, the displacement on demand remedial fault indication control will be described. In step 100, control determines whether deactivation has been signaled. If false, control loops back to step 100. If step 100 is true, control sets a counter equal to one in step 102. In step 104, control determines the throttle preload. Control increases the throttle based on the throttle preload in step 106. In step 108, control retards engine spark based on the throttle preload. In step 110, control initiates a transition to the deactivated mode.

Control monitors the signals of the various sensors to determine whether a DOD fault is present. In step 112, control monitors the engine speed change to determine if it is within the threshold. If step 112 is false, control signals a fault in step 114. If step 112 is true, control loops to step 116. In step 116, control determines whether the transmission gear is correct. If step 116 is false, control signals a fault in step 118. If step 116 is true, control loops to step 120. In step 120, control determines whether the number of fueled cylinders is correct for the deactivation mode. If step 120 is false, control signals a fault in step 122. If step 120 is true, control loops to step 124.

In step 124, control determines whether a DOD fault has been signaled. If step 124 is false, control completes transition into the deactivated mode in step 126. The engine operates in the deactivated mode with the throttle preload. If a DOD fault has been signaled, control cancels the throttle preload in step 128. In step 130, control determines whether the counter is greater than a threshold value. In other words, control determines whether a transition into the deactivated mode has been attempted at least a threshold number of times. If step 130 is false, control loops back to step 104, which cancels the transition into the deactivated mode and increments the counter in steps 132 and 134, respectively. If step 130 is true, control signals an error based on the particular DOD fault in step 136. The error signal enables the passenger or maintenance personnel to determine the nature of the DOD fault so remedial action can be taken. In step 126, control completes transition into the deactivated mode operating the engine without the throttle preload.

Operation of the engine 16 without the throttle preload may increase engine instability that may be felt by the vehicle occupant. When examining the vehicle for the cause of the engine instability, the error indicator or error flag informs the maintenance personnel of the source of the DOD fault. The maintenance personnel correct the error and reset the error indicator and error flag.

Figure 3:
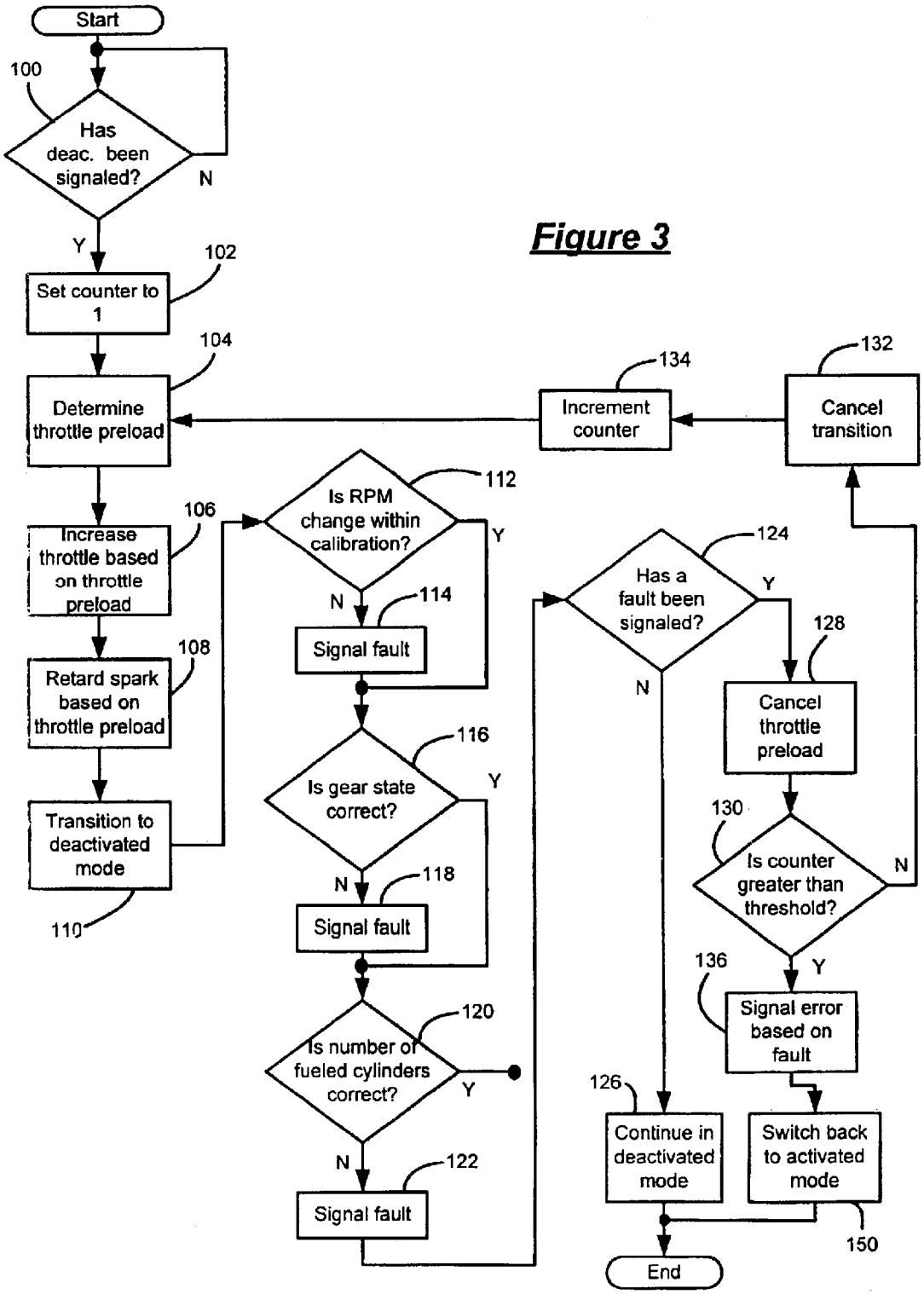
FIG. 3 is a flowchart illustrating steps performed by an alternate displacement on demand controller.

Referring now to FIG. 3, many of the steps from FIG. 2 are performed. However, after step 136, control continues with step 150 and switches back to the activated mode. Therefore, upon identify faults, transition to the deactivation mode terminates and the engine is operated in the activated mode. Fault codes are set and/or audio and/or visual indicators can be used as described above.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner: upon a study of the drawings, the specification and the following claims.

What is claimed is:

1. An engine control system for monitoring torque increase during cylinder deactivation for a displacement on demand (DOD) engine having activated and deactivated modes, comprising:

a throttle; and a controller that adjusts a preload of said throttle prior to a cylinder deactivation event, determines whether a DOD fault is present during said cylinder deactivation event, wherein, if said fault is present for a predetermined time, said controller one of operates said engine without said preload in said deactivated mode and switches said engine back to said activated mode.

2. The engine control system of claim 1 wherein said controller cancels said preload if said DOD fault is present and resets said preload it said predetermined period has not expired.

3. The engine control system of claim 1 wherein said controller retards spark based on said preload prior to said cylinder deactivation event.

4. The engine control system of claim 1 further comprising an indicator receiving a DOD fault signal from said controller after said predetermined time period expires to indicate the presence of said DOD fault.

5. The engine control system of claim 1 wherein said preload is based on a desired throttle position during said cylinder deactivation event.

6. The engine control system of claim 1 wherein said DOD fault is an engine speed fault.

7. The engine control system of claim 6 further comprising an engine speed sensor generating an engine speed signal that is processed by said controller to determine whether said engine speed fault is present.

8. The engine control system of claim 1 wherein said DOD fault is a transmission gear fault.

9. The engine control system of claim 8 further comprising a transmission sensor that generates a signal based on a current transmission gear, said controller processing said signal to determine whether said transmission gear fault is present.

10. The engine control system of claim 1 wherein said DOD fault is a fueled cylinder fault.

11. The engine control system of claim 10 further comprising a fuel supply sensor that generates a fuel supply signal, said controller processing said signal to determine whether said fueled cylinder fault is present.

12. A method for monitoring cylinder deactivation for a displacement on demand (DOD) engine, comprising:

setting a throttle preload prior to a cylinder deactivation event:

determining whether a DOD fault is present during said cylinder deactivation event; and if said fault is present for a predetermined time one of operating said engine without said preload in said deactivated mode and switching said engine back to said activated mode.

13. The method of claim 12 further comprising:

canceling said throttle preload if said DOD fault is present; and resetting said throttle preload if said predetermined period has not expired.

14. The method of claim 12 further comprising retarding spark based on said throttle preload prior to said cylinder deactivation event.

15. The method of claim 12 further comprising signaling an error if said DOD fault is present.

16. The method of claim 12 further comprising determining said throttle preload based on a desired throttle position during said cylinder deactivation event.

17. The method of claim 12 wherein said DOD fault is an engine speed fault.

18. The method of claim 12 wherein said DOD fault is a transmission gear fault.

19. The method of claim 12 wherein said DOD fault is a fueled cylinder fault.

20. A method of operating a displacement on demand (DOD) engine, comprising:

determining a throttle preload;

setting said throttle preload prior to a cylinder deactivation event;

determining whether a DOD fault is present during said cylinder deactivation event;

canceling said throttle preload; and if said fault is present for a predetermined time, one of operating said engine without said preload in said deactivated mode and switching said engine back to said activated mode.

21. The method of claim 20 further comprising resetting said throttle preload it said predetermined period has not expired.

22. The method of claim 20 further comprising retarding spark based on said throttle preload prior to said cylinder deactivation event.

23. The method of claim 20 further comprising signaling an error if said DOD fault is present.

24. The method of claim 20 further comprising determining said throttle preload based on a desired throttle position during said cylinder deactivation event.

25. The method of claim 20 wherein said DOD fault is an engine speed fault.

26. The method of claim 20 wherein said DOD fault Is a transmission gear fault.

27. The method of claim 20 wherein said DOD fault is a fueled cylinder fault.

* * * * *